United States Patent [19]

Beaumont

[11] 4,328,694

[45] May 11, 1982

[54] OUTLET TUBE AND METHOD

[76] Inventor: Peter W. Beaumont, 6806 1st Ave., North, Birmingham, Ala. 35206

[21] Appl. No.: 157,569

[22] Filed: Jun. 9, 1980

[51] Int. Cl.[3] ..... B21D 51/38

[52] U.S. Cl. ..... 72/379; 405/120; 413/15

[58] Field of Search ..... 285/189; 52/16; 405/120; 72/51, 368, 379; 29/157 R; 113/116 HA, 116 UT, 116 V, 116 DD, 120 E

[56] References Cited

U.S. PATENT DOCUMENTS 628,643 7/1899 Abrahams ..... 72/51
1,455,525 5/1923 Finley ..... 113/120 E
1,785,025 12/1930 Felsenthal ..... 72/379
2,274,078 2/1942 Marzolf ..... 405/120

*Primary Examiner*—Lowell A. Larson
*Attorney, Agent, or Firm*—Woodard, Weikart, Emhardt & Naughton

[57] ABSTRACT

An outlet tube comprising a unitary material sheet folded into a rectangular shape and having overlapping ends secured with rivets, the outlet tube further including flanges extending outwardly from one end of the walls of the rectangular shape, and notches at the corners of the other end of the walls to permit folding inward of the end portions of the walls to provide a taper to the rectangular shape.

2 Claims, 5 Drawing Figures

OUTLET TUBE AND METHOD

BACKGROUND OF THE INVENTION

1. Field of the Invention

The present invention relates to the field of gutters and downspouts, and in particular to an outlet tube for connection of a downspout with a gutter, and a method for making the same.

2. Description of the Prior Art

The typical prior art gutter systems include a gutter which is mounted horizontally on the eaves of a building, and a downspout which is connected with the gutter and directed vertically along the building to deliver the water to the ground. The downspout is connected with the gutter by an outlet tube which is a generally rectangular shaped box which is open at both ends and which at the top end includes outwardly extending flanges for reception upon the floor of the gutter for securement of the outlet tube to the gutter.

In the prior art, the usual method for making the outlet tube is a "deep drawing" process in which the appropriate metal is drawn through dies or a series of progressive dies, and is then passed through a "cut die" to remove any extraneous material. Aluminum is the common material for making outlet tubes, and in the deep drawing process is used as a "zero hard" alloy which provides a composition which will not crack in the drawing process. In the process of forming the outlet tube in the punch press dies, the aluminum is work hardened and therefore the zero hard alloy is required. Because of these special requirements of the deep drawing process on the properties of the metal, the material costs for this process are high. It is therefore desirable to provide an outlet tube, and a method for making the same, which does not require special alloys and which also is simple and readily accomplished without expensive machinery.

Another aspect of the prior art is the provision of an inward taper of the outlet tube in the direction away from the flanges so that the downspout can be readily received around the rectangular box portion of the outlet tube. Since the outlet tube does not provide for any simple alteration to modify the degree of taper, it is necessary to provide the outlet tube with a taper which is sufficient for all purposes. For example, the taper would have to be sufficient so that a person installing a downspout at ground level can direct the upper end of the downspout over the outlet tube from a considerable distance away from the gutter. As a result, the outlet tubes have a greater taper than would usually be desired, and the area available for drainage into the downspout is diminished, sometimes by as much as one-third. It is therefore also desirable to provide an outlet tube which can be readily modified to provide an inward taper away from the flanges, but which does not provide a greater taper than necessary for a given circumstance. It is also desirable to provide an outlet tube which is of a thinner wall construction to further maximize the area available for drainage, as opposed to the deep drawn outlet tubes of the prior art which due to the nature of the forming process will have substantial wall thicknesses.

SUMMARY OF THE INVENTION

In one aspect of the present invention, a flanged outlet tube is provided for mounting within a gutter to provide a connection with a downspout, which includes a rectangular member which is a unitary piece folded at four corners and including five wall portions, the two end wall portions being secured together to form the rectangular shape. The member further includes flanges which are unitary with the wall portions of the rectangular member, which flanges extend outwardly of the wall portions. In a related aspect of the present invention, a method and structure are provided for tapering the wall portions inwardly at a location opposite the flanges, and methods are also provided for making the same.

It is an object of the present invention to provide an improved outlet tube.

It is a further object of the present invention to provide an outlet tube which does not require the use of special metals or alloys, and which is therefore relatively inexpensive.

It is a further object of the present invention to provide an outlet tube which is prepared by a simple and readily performed method which does not require the use of drawing and die cutting operations, and which therefore does not require the use of special equipment.

Another object of the present invention is to provide an outlet tube which is designed for including an inward taper of the wall portions of the outlet tube away from the connecting flanges.

It is another object of the present invention to provide a simple and easily performed method for forming an outlet tube, which method does not utilize complicated or expensive machinery and also which does not require the use of special alloys or metals.

It is a further object of the present invention to provide a method for the formation of an outlet tube which utilizes a flat sheet of material which can therefore be easily, inexpensively and compactly packaged for shipping, and which also provides for the simple and precise formation of an outlet tube therefrom.

Further objects and advantages of the present invention will become apparent from the description of the preferred embodiment which follows.

DESCRIPTION OF THE PREFERRED EMBODIMENT

Figure 1:
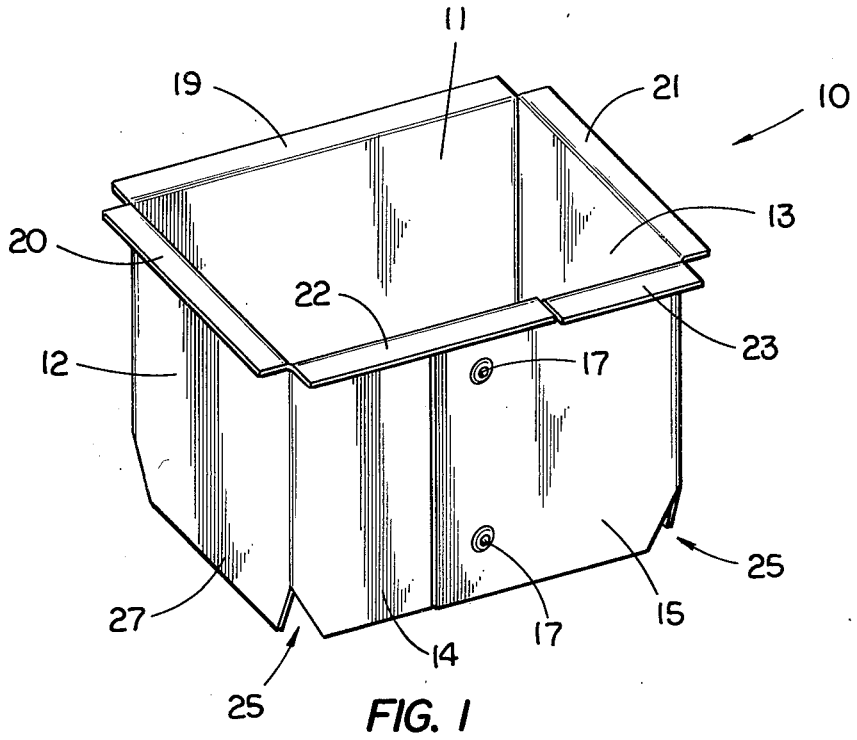
FIG. 1 is a perspective view of an outlet tube constructed in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides an outlet tube which is simply and readily constructed, and which utilizes ordinary materials as opposed to special metals or alloys. A method for producing the outlet tube from a flat material sheet is also provided, which makes the packaging and shipping of the material very inexpensive. The outlet tube may be formed from the material sheet in a quick and simple method which may be performed at the job site with ordinary tools.

Referring in particular to the drawings, there is shown an outlet tube 10 constructed in accordance with the present invention. The outlet tube 10 comprises a rectangular member which is open at both ends and which comprises a unitary piece of material folded into the desired shape. In the folded condition as shown in FIG. 1, the rectangular outlet tube includes four corners which define a rear wall portion 11, sidewall portions 12 and 13 and front wall portions 14 and 15. The end portions of the unitary material are the front wall portions 14 and 15, and they are combined to define the front wall of the outlet tube.

Securement means are provided for securing the front wall portions 14 and 15 together to complete the rectangular shape of the outlet tube. In the preferred embodiment, the front wall portions 14 and 15 include overlapping portions which define two pairs of aligned holes 16, within which rivets 17 are received in normal fashion. It will be appreciated that other means may be used to form the connection between the front wall portions, but the defined method is preferred since the use of rivets is common in this art and for the people who would be installing the outlet tube, and provides a quick and simple connection which will stay secured during use.

As is well understood, the outlet tube is received within an aperture in the bottom wall 18 of a gutter. The outlet tube includes flanges 19–23 which extend outwardly of the rectangular box and are received against the upper surface of the gutter floor 18. The flanges 19–23 extend outwardly from the wall portions 11–15, respectively. It will be appreciated, however, that only one of the front wall portions 14 and 15 need have the outwardly extending flange, depending upon the extent to which a single front wall portion spans the front of the outlet tube. Thus, the front wall portion 14 could be approximately equal in length to the rear wall portion 11 and the other front wall portion 15 could have only a minor extension along the front of the outlet tube. In this configuration, the front wall portion 14 could carry the outwardly extending flange with the other front wall portion 15 not including a flange. However, to provide a simple and sure connection of the front wall portions, and to facilitate insertion of the outlet tube into the gutter opening and of the downspout 24 over the outlet tube, it is desirable to have the connection spaced inwardly of the corners and to have each of the front wall portions include an outwardly extending flange, such as 22 and 23.

Figure 2:
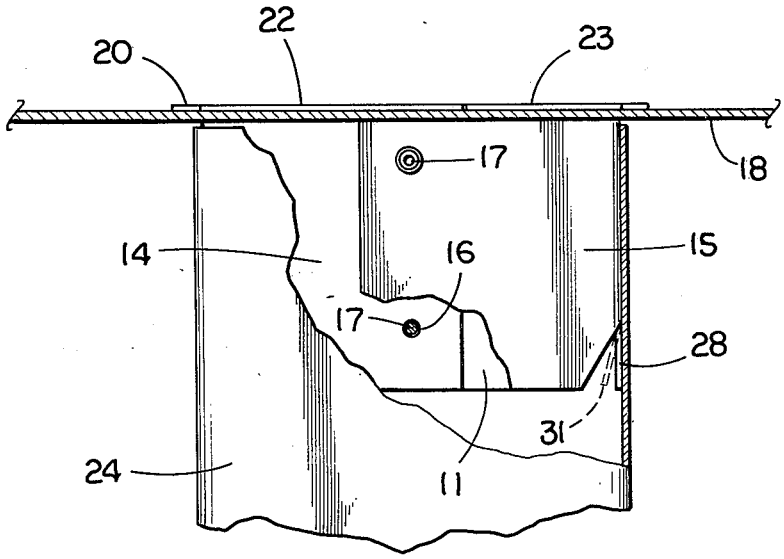
FIG. 2 is a front, elevational view of the outlet tube of FIG. 1 shown mounted within a gutter.
Figure 3:
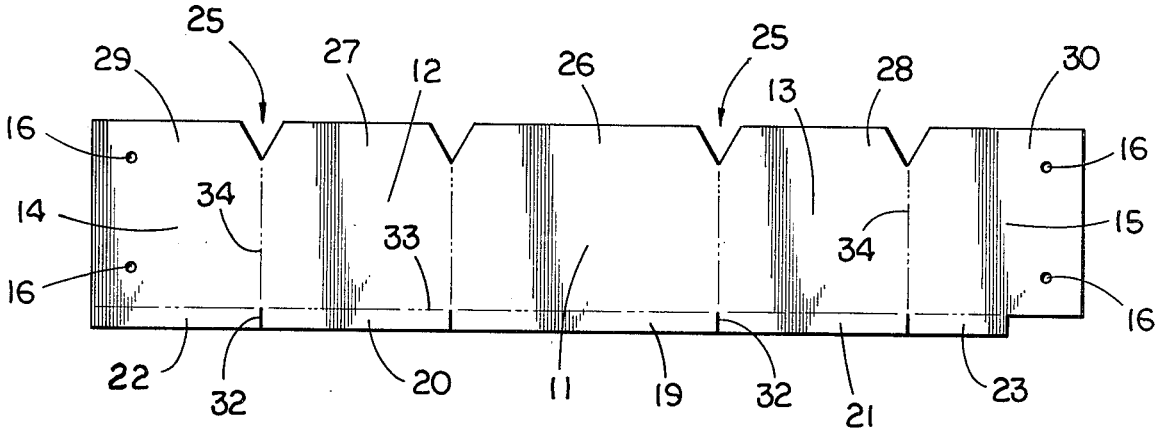
FIG. 3 is a top, plan view of a material sheet useful in forming an outlet tube constructed in accordance with the present invention.

As shown particularly in FIGS. 1 and 3, it is preferable that the outlet tube include V-shaped notches 25 aligned with the corners of the outlet tube. The presence of these notches permits the portions 26–30 extending therebetween to be folded inwardly, as shown at 31 in FIG. 2, to provide an inward taper of the rectangular outlet tube at the bottom end away from the flanges. This tapered bottom may be desirable to facilitate insertion of the downspout 24 over the rectangular box portion of the outlet tube. The V-shaped notches provide a chamfered corner to the bottom ends of the wall portions to permit this inward bending of these bottom ends to form the taper.

Figure 4:
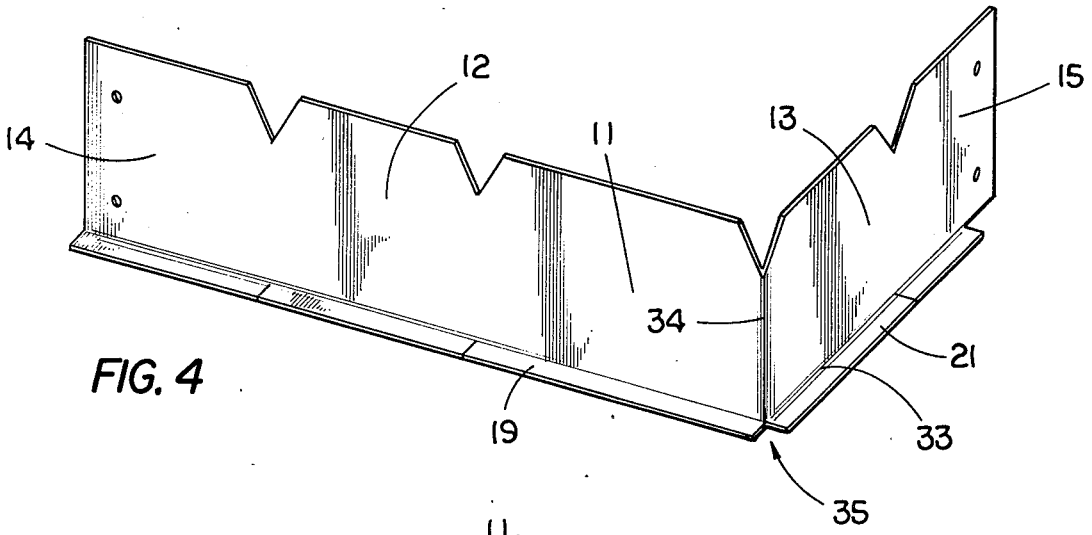
FIG. 4 is a perspective view of the shape of the material sheet of FIG. 3, shown in an intermediate step leading towards the formation of an outlet tube in accordance with the present invention.
Figure 5:
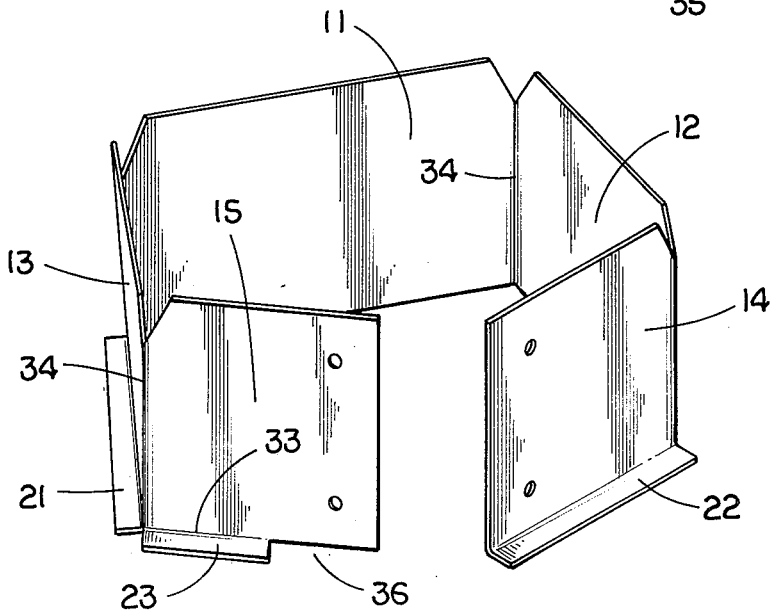
FIG. 5 is a perspective view of a form of the material sheet of FIG. 3 in a further step in the preparation of an outlet tube of the present invention.

Referring in particular to FIGS. 3–5, a preferred method for constructing the outlet tube of the present invention is shown in consecutive steps. A unitary, flat member is provided (FIG. 3) which includes an edge in which four spaced apart separation regions are provided. Preferably, these separation regions comprise score lines 32 which will permit a ready separation of the material along those lines. It will be appreciated that the separation regions may as well be cuts extending inwardly of the edge, serrated portions or actual notches. However, the score line approach is preferred since it helps to maintain the integrity of the flat member prior to assembly as an outlet tube. This is particularly true since the member is preferably folded in an L-shape along a fold line 33 prior to shipping. If the separation regions 32 comprise notches or cut slits, then in the L-shaped configuration the member may readily fold at the location of the separation regions, whereas a score line will inhibit the member from folding at this location until it is desired for assembly.

In the method of preparing the outlet tube, the L-shaped member is then folded at the positions corresponding to the separation regions, such as at fold line 34, which then define the corners of the rectangular outlet tube. In the embodiment in which the separation regions comprise score lines, the folding of the L-shaped member will cause the materal to break along the score lines to form the openings 35 which permit the material to fold and which define the edges of the flanges. Once the member has been folded at each of the corner locations 34, as shown in FIG. 5, the end wall portions 14 and 15 are secured together to form the rectangular shape. As previously indicated, a preferred securement means is the provision of holes on the front wall portions 14 and 15 which align when the wall portions are overlapped, and rivets are then inserted through the holes to secure the wall portions together.

It will be appreciated that the steps in the method of preparing the outlet tube may be varied to a certain extent. Primarily, the flat member of FIG. 3 could be folded along the corner locations 34 prior to the folding up of the flange areas along the fold line 33. Once in the rectangular shape, each of the flanges could individually be folded outwardly to form the final configuration. It is preferred, however, that the member first be folded into the L-shaped configuration for two primary reasons. First, the member may be folded into the L-shape prior to shipping, and particularly in combination with the use of score lines as opposed to actual separations will help to maintain the member in the desired shape without bending. Also, the folding of the member first into the L-shape, in combination with the use of score lines, will cause the flanges to automatically separate at the corner locations when the member is folded into the rectangular shape.

As previously indicated, either one or both of the front wall portions 14 or 15 may include an outwardly extending flange, depending upon the particular configuration of the wall portions. In the preferred embodiment, each of the front wall portions carries a flange and the two wall portions are connected approximately at the center. In this configuration, it is preferred that one of the flanges 23 be stopped short of the end of the wall portion 15 so that flanges 22 and 23 do not overlap when the wall portions are overlapped for connection. This leaves a gap 36 (FIG. 5) which accommodates the flange 22 when the outlet tube is fully assembled. It will be appreciated, however, that the flange 23 could extend to the edge of the wall portion 15, in which case the flanges 22 and 23 would overlap when connected.

The present invention provides an outlet tube and method for making same which can use almost any type of metal or gauge of metal which can be bent and cut. The material may include copper, galvanized steel, aluminum, or other materials and even including scrap materials or impure alloys. No special metal or alloy is required and no special techniques such as deep drawing are necessary. The formation of the material sheet from which the outlet tube is prepared may be formed with a relatively small punch press, and the only requirements are a cut die and a die preferably for forming a 90° flange bend. The final bending and riveting of the outlet tube may be quickly accomplished by the installer, thus enabling the material to be shipped in the flat configuration which saves on shipping and handling expense. The outlet tube also may be formed from thinner walled material and may be used without a significant taper so that the area available for drainage is increased in many instances.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for facilitating the connection of a gutter with a downspout by means of an outlet tube which comprises the steps of:

a. providing a unitary, flat member having a first edge, the member including four spaced apart separation regions extending inwardly from the first edge and dividing the member into five wall portions, the member further including notches aligned opposite the separation regions;

b. forming flanges extending outwardly of the wall portions of the member;

c. folding the flat member into a rectangular shape with the separation regions at the corners of the rectangular shape, the two end wall portions comprising one side of the rectangular shape and the other three wall portions forming the other three sides of the rectangular shape, the two end wall portions being folded to overlap, the separation regions comprising score lines and the folding of the wall portions into a rectangular shape causing the flanges to separate at the score lines;

steps b. and c. comprising folding the flat member into a generally L-shaped configuration with one portion of the L-shape including the wall portions and the other portion of the L-shape including the flanges, and then folding the wall portions of the member into a rectangular shape;

d. securing together the overlapped end wall portions to retain the member in the rectangular shape; and e. folding the portions between the notches inwardly to form a tapered end of the rectangular shape.

2. A method for facilitating the connection of a gutter with a downspout by means of an outlet tube which comprises the steps of:

a. providing a unitary, flat member having a first edge, the member including four spaced apart separation regions extending inwardly from the first edge and dividing the member into five wall portions, the member further including notches aligned opposite the separation regions;

b. forming flanges extending outwardly of the wall portions of the member;

c. folding the flat member into a rectangular shape with the separation regions at the corners of the rectangular shape, the two end wall portions comprising one side of the rectangular shape and the other three wall portions forming the other three sides of the rectangular shape, the two end wall portions being folded to overlap, the separation regions comprising score lines and the folding of the portions of the flat member between the separation regions outwardly of the sides of the rectangular shape causing the flanges to separate at the score lines;

steps b. and c. comprising folding the flat member in a rectangular shape and then folding the portions of the flat member between the separation regions outwardly of the sides of the rectangular shape; and d. securing together the overlapped end wall portions to retain the member in the rectangular shape; and e. folding the portions between the notches inwardly to form a tapered end of the rectangular shape.

* * * * *